US005410390A

United States Patent [19]

Miura et al.

[11] Patent Number: 5,410,390

[45] Date of Patent: Apr. 25, 1995

[54] IMAGE FORMING APPARATUS HAVING TRANSFER MATERIAL CARRYING MEMBER WITH SPECIFIC RESISTANCE RATIO

[75] Inventors: Yasushi Miura; Hisashi Fukushima, both of Kawasaki, Japan

[73] Assignee: Canon Kabushiki Kaisha, Tokyo, Japan

[21] Appl. No.: 26,780

[22] Filed: Mar. 5, 1993

[30] Foreign Application Priority Data

Mar. 5, 1992 [JP] Japan ..... 4-083449

[51] Int. Cl.[6] ..... G03G 15/14

[52] U.S. Cl. ..... 355/271; 355/274; 355/327

[58] Field of Search ..... 355/272, 273, 274, 275-277, 355/219, 326, 327, 271; 361/220, 221, 225, 230

[56] References Cited

U.S. PATENT DOCUMENTS 5,172,173 12/1992 Goto et al. ..... 355/275

5,249,022 9/1993 Watanabe et al. ..... 355/271

FOREIGN PATENT DOCUMENTS 3-233481 10/1991 Japan .

3-233577 10/1991 Japan .

*Primary Examiner*—A. T. Grimley

*Assistant Examiner*—Shuk Y. Lee

*Attorney, Agent, or Firm*—Fitzpatrick, Cella, Harper & Scinto

[57] ABSTRACT

An image forming apparatus includes image bearing member; a toner image forming device for forming a toner image on the image bearing member; a transfer material carrying member carrying a transfer material; a transfer charging member for transferring the toner image from the image bearing member onto a transfer material carried on the transfer material carrying member, the transfer charging member being contactable to a backside of the transfer material carrying member not contactable to the transfer material; wherein $(\alpha_B+\alpha_C)\alpha_B \leqq 100$ is satisfied where $\alpha_B$ is a resistance of the transfer charging member, and $\alpha_C$ is a constant resistance between the transfer charging member and the transfer material carrying member.

10 Claims, 6 Drawing Sheets

IMAGE FORMING APPARATUS HAVING TRANSFER MATERIAL CARRYING MEMBER WITH SPECIFIC RESISTANCE RATIO

FIELD OF THE INVENTION AND RELATED ART

The present invention relates generally to an image forming apparatus, more particularly to an image forming apparatus of an electrophotographic or electrostatic recording type or the like in which a toner image formed on an image bearing member is transferred onto a transfer material carried on a transfer material carrying member, using a transfer electric field, thus providing an image on the transfer material. Examples of such an image forming apparatus include an electrophotographic copying machine, printer or other various recording machines.

An image forming apparatus is known in which a toner image formed on an image bearing member in the form of a photosensitive drum is transferred onto a transfer material carried on a transfer material carrying member in the form of a dielectric sheet. Such an image forming apparatus is suitable for full-color image formation in which a plurality of toner images having different color and formed on the photosensitive drum are sequentially and superposedly transferred onto the transfer material.

In a conventional image forming apparatus, a corona transfer charger is used to transfer the toner image from the photosensitive drum onto the transfer material, and therefore involves the following problems.

In order to effect the image transfer, it is required that a discharging wire of the transfer charger is supplied normally with such a high voltage as 6–8 KV. Only a part of the corona current produced flow into the photosensitive drum, and the rest flows to a grounded shield, and therefore, the corona current larger than the current contributable to the actual image transfer, is required. Therefore, a large voltage capacity and current capacity voltage source is required for the transfer charger. This leads to high voltage wiring and insulations with the result of bulky transfer device and high cost device.

In addition, ozone is produced by the corona discharging, and influences the photosensitive drum.

Japanese Laid-Open Patent Applications No. 233481/1991 and 233577/1991 under the name of the assignee of this application, have proposed the following. An electrically conductive metal sheet, blade or roller is provided with elastic synthetic resin sheet at an end, is contacted to a backside of a dielectric sheet, and a voltage is applied to it, by which a transfer electric field is generated without use of corona charger as the transfer electric field forming means. With this structure, the contact injection current from the contact conductive member is substantially equal to the transfer material attraction current and the toner transfer current, and therefore, the electric current efficiently contributes to the transfer action. Therefore, unlike the case of the corona charger used as the transfer charger, low ozone is produced, and low voltage and low current is enough to effect high efficiency image transfer.

In addition a brush type conductive member is known as being capable of contacting to the backside of the dielectric sheet of the transfer drum, softly, with low pressure and at high density.

However, in this structure, abnormal electric discharge occurs in a microscopic gaps between the fine fibers of the conductive brush and the dielectric sheet, under low humidity condition, and therefore, local transfer void tend to occur with the results of narrowed transfer region.

SUMMARY OF THE INVENTION

Accordingly, it is a principal object of the present invention to provide an image forming apparatus in which abnormal discharge is prevented between the transfer material carrying member and a transfer charging member.

It is another object of the present invention to provide an image forming apparatus in which improper image formation such as local transfer void, can be avoided.

It is another object of the present invention to provide an image forming apparatus in which good images can be provided under a wide range of ambient conditions.

These and other objects, features and advantages of the present invention will become more apparent upon a consideration of the following description of the preferred embodiments of the present invention taken in conjunction with the accompanying drawings.

DETAILED DESCRIPTION OF THE PREFERRED EMBODIMENTS

Figure 5:
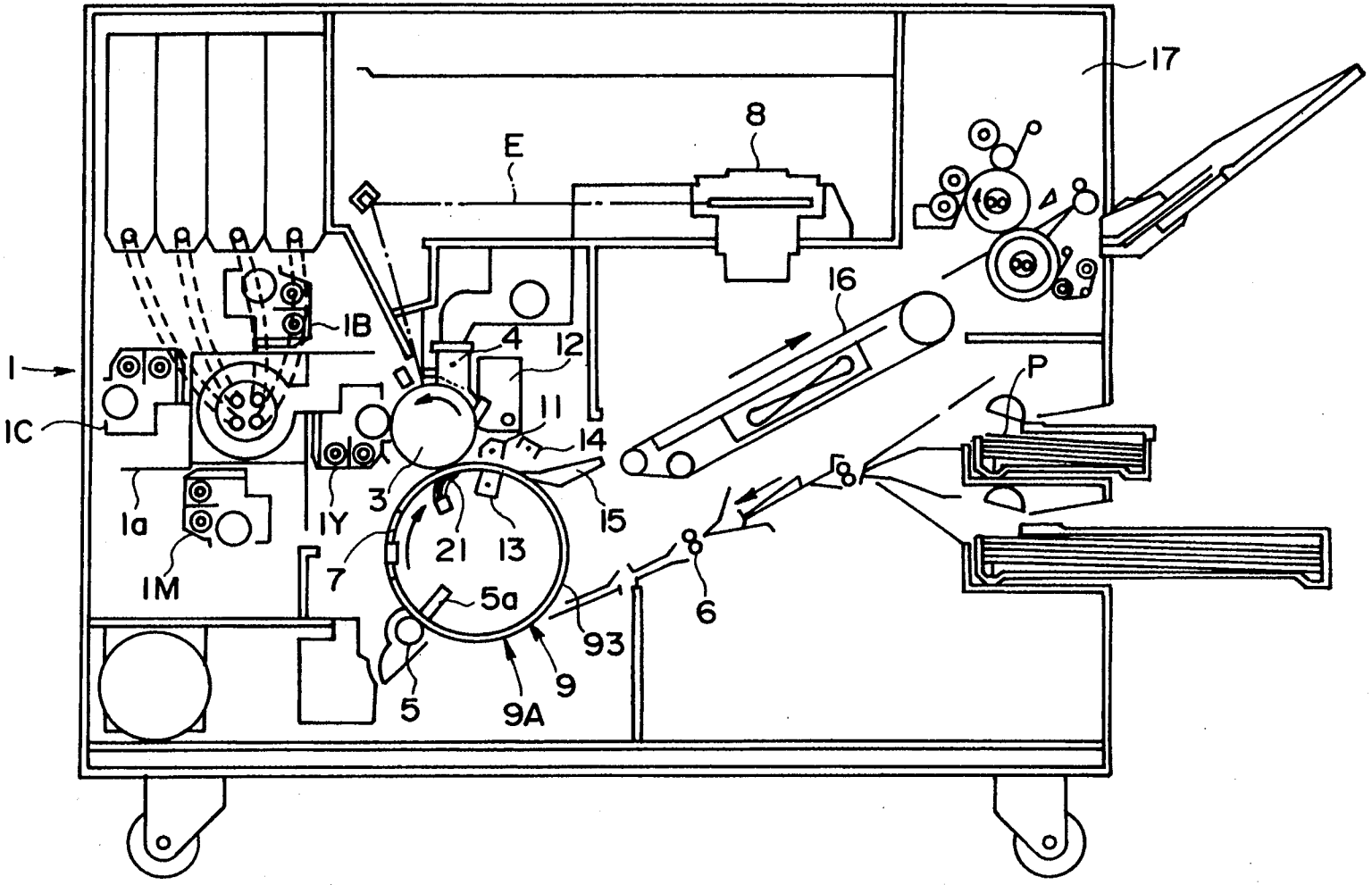
FIG. 5 is a general arrangement of the image forming apparatus according to this invention.

Referring first to FIG. 5, there is shown an image forming apparatus in the form of a multi-color electrophotographic machine according to an embodiment of the present invention. It comprises a photosensitive drum 3, substantially at the center thereof, functioning as an image bearing member supported for rotation in the direction indicated by an arrow. Around the photosensitive drum 3, there are disposed image forming means. The image forming means may be of any type. In this embodiment, it comprises a primary charger 4 for uniformly charging the photosensitive drum, exposure means 8 such as laser beam exposure device for forming an electrostatic latent image on a photosensitive drum 3 by projecting light image color separated or light image corresponding thereto, and a rotary type developing device 1 for developing the electrostatic latent images on the photosensitive drum 3 into visualized images.

The rotary type developing device 1 comprises a generally cylindrical housing 1*a* rotatably supported, and four developing means 1M, 1C, 1Y and 1B which contain a yellow developer, a magenta developer, a cyan developer and a black developer, respectively. The rotary developing device 1 presents a proper one of the developing devices to a developing position where it is faced to the outer peripheral surface of the photosensitive drum 3, by rotation of the housing 1*a*. The electrostatic latent images on the photosensitive drum 3 are sequentially developed with corresponding color developers, so that four color image can be developed.

The image produced by developing the latent image on the photosensitive drum 3, that is, the toner image, is transferred onto a transfer material P which is fed to an image transfer position where it is faced to the photosensitive drum 3, by a transfer drum 9 of the transfer device 9*a*.

Figure 6:
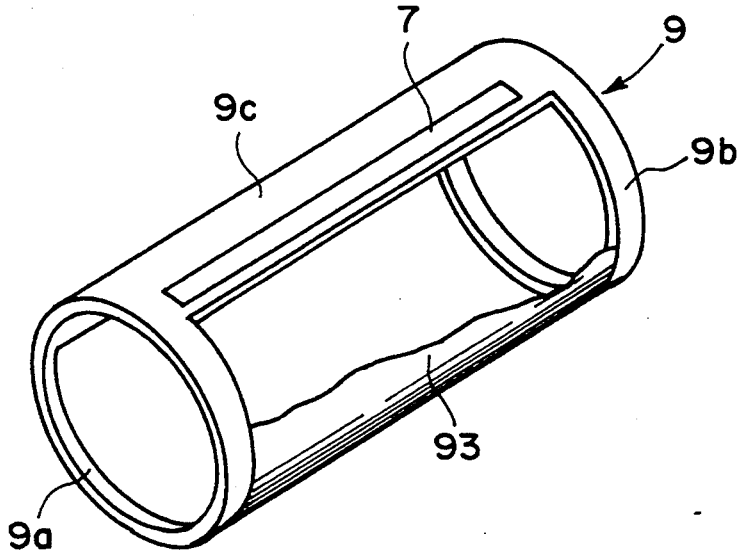
FIG. 6 is a perspective view of a transfer drum of a transfer device in the image forming apparatus of FIG. 5.

The transfer drum 9, as shown in FIG. 6, comprises cylinders 9*a* and 9*b* at longitudinal opposite ends, a connecting member 9*c* connecting them, and a transfer material carrying sheet 93 stretched covering the opening defined by the cylinders 9*a*, 9*b* and the connecting member 9*c*. The transfer material carrying sheet 93, is normally, of polyethylene terephthalate, polyvinylidene fluoride resin film or the like (dielectric material sheet). The connecting member 9*c* is provided with a transfer grippers 7 for gripping the transfer material fed from the sheet feeding device.

As shown in FIG. 5, inside and outside of the transfer drum 9, there are disposed a transfer charger 21 and discharging means comprising inside discharger 13 and outside dischargers 11 and 14.

A full-color image forming process in this multi-color electrophotographic copying machine will be described. The photosensitive drum 3 is uniformly charged by a primary charger 4, and is exposed to light image E in accordance with the image information by exposure means, so that an electrostatic latent image is formed on the photosensitive drum 3. The latent image is developed by the rotary developing device 1 into a toner image of toner particles having average particle size of 8–10 microns, for example, and mainly comprising resin material.

On the other hand, the transfer material P is transported to the photosensitive drum 9 in synchronism with the image on the photosensitive drum 3 along a sheet feed guide 18, by a registration roller 6. It is gripped by grippers 7 or the like and is carried on the transfer drum 9. It is then fed to the image transfer region where it is contacted to the photosensitive drum 3, by rotation of the transfer drum 9. In the transfer region, it is subjected to a corona discharge of a polarity opposite from that of the toner at the backside of the dielectric sheet 93, by transfer charger 21, so that the toner image is transferred from the photosensitive drum 3 onto the transfer material P.

In this manner, the first color toner image (yellow, for example), the second color toner image (magenta, for example), the third color toner image (cyan, for example) and the fourth color toner image (black, for example) are transferred one-by-one in the image transfer region. After all of these images are transferred, the transfer material P is electrically discharged by the dischargers 11, 13 and 14, and is separated from the photosensitive drum 9 with the aid of the separation pawls 15. It is then transported to the fixing device 17 on a conveyer belt. The transfer material P is subjected to the image fixing and color mixing operation so that the toner image is fixed to a permanent full-color image. Finally, it is discharged to the outside of the apparatus.

On the other hand, the photosensitive drum 3 is cleaned by a cleaning device 12 so that the residual toner is removed from the surface thereof, and therefore, it is prepared for the repeated image forming process operation. The surface of the dielectric sheet 93 of the transfer drum 9 is similarly cleaned by a cleaning device 5 of fur brush or the like and auxiliary cleaning means 5*a*, and thereafter, it is used for the next image formation process.

Figure 1:
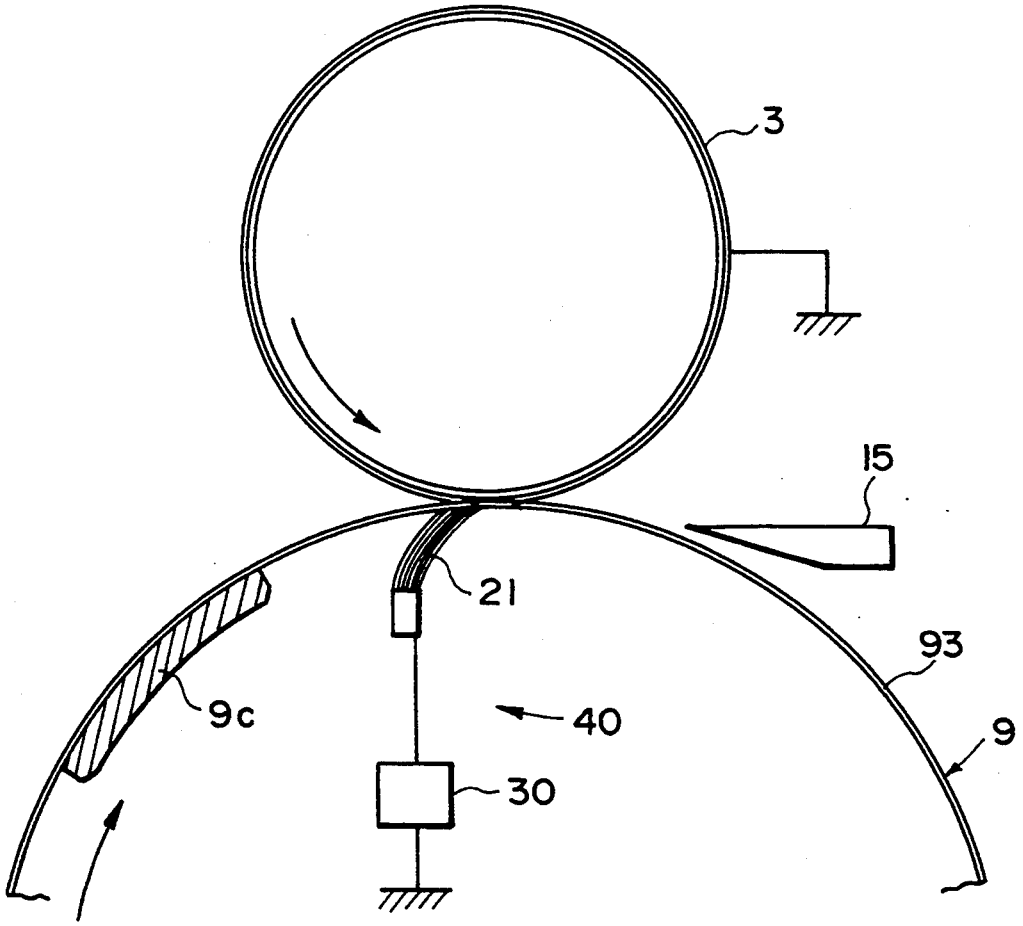
FIG. 1 is a sectional view of an image transfer region in an image forming apparatus according to an embodiment of the present invention.

Referring now to FIG. 1, there is shown a structure of transfer means in the image forming apparatus of FIG. 5. As shown in FIG. 1, a transfer electric field forming means 40 according to this embodiment of the present invention is disposed at an inside (backside) of a dielectric sheet 93 in the image transfer position where the image bearing member in the form of the photosensitive drum 3 and the surface of the transfer drum 9 in the form of the dielectric sheet 93, are contacted. The transfer electric field forming means 40 mainly comprises a conductive brush 21 transfer charger contacting to the backside of the dielectric sheet 93 in the image transfer position, a bias voltage source 30 for applying transfer electric field generating voltage to the conductive brush 21.

The conductive brush 21 comprises fine and elastic electroconductive fibers. Examples of the fibers include fine acrylic resin dyed with copper sulfide for electroconductivity, stainless steel fibers having a diameter of approx. 8–15 microns, fibers of resin material such as acrylic, nylon, polyester or rayon resin material, plated with metal, resin fibers kneaded or mixed with conductive fine particles such as metal powder or the like, and carbon fibers given the conductivity by carbonizing resin fibers or the like. The volume resistivity of the conductive fibers is not more than $10^{10}$ ohm.cm, preferably not more than $10^{8}$ ohm.cm.

The conductive brush 21 extends from its supported portion to the downstream in the direction of the movement of the dielectric sheet 93. The elastic conductive brush 21 is press-contacted to the backside of the dielectric sheet 93 at a position where the transfer material P carried on the dielectric sheet starts to separate from the photosensitive drum 3, at a position where the contact starts, or at a position close thereto. The transfer charging member may be in the form of elastic sheet, blade or roller in place of the brush.

However, the elastic sheet, blade or roller type transfer charging member establishes a linear line contact with the dielectric sheet. Although the contact thereof with the dielectric sheet is macroscopically uniform, the contact is non-uniform locally along the direction of the length of the photosensitive drum, if it is seen macroscopically.

Therefore, if the voltage applied to the transfer charging member is low, the transfer injection current is not sufficient where the press-contact is not sufficient, with the result of non-uniform transfer efficiency. In this case, the toner image transferred onto the transfer material involves dark and light stripes extending in parallel with the movement direction of the transfer material. If the applied voltage is high, a gap discharge occurs in the microscopic gap between the dielectric sheet and the transfer charging member where the contact is weak. If this occurs, the toner image on the transfer material involves similar stripe non-uniformity. In addition, local transfer void may occur. Therefore, the usable range of the applied voltage to the contact conductive member is small.

Even if the proper voltage is applied, the difference of the state of contact results in the difference in the transfer efficiency, and therefore, slight non-uniformity occurs in a monochromatic image forming apparatus. This may be permissible in the monochromatic image. However, in an image forming apparatus for forming a multi-color image in which different color toner images are overlaid on the transfer material, the density non-uniformity appear remarkable stripes, and therefore, it is not permissible.

For the purpose of eliminating the difference of the contact pressure, the contact pressure of the charging member to the dielectric sheet may be increased. However, if the contact pressure is high, the dynamic friction between the dielectric sheet and the charging member increases with the result of increased load to the dielectric sheet. This tends to occur deviation or the like of the dielectric sheet. Then, the transfer material carried thereon may be deviated. Similarly to the above, it is not a significant problem in the case of image forming apparatus for forming monochromatic images, but in the case of multi-color image forming apparatus, it is a significant problem since it would result in color deviation, color non-uniformity. In addition, the toner image is strongly press-contacted to the photosensitive drum at the time of the image transfer action, and therefore, the transfer efficiency of the image onto the transfer material decreases, or the service lives of the dielectric sheet and the transfer charging member become shorter, and then, they have to be frequency exchanged. Thus, the cost of the transfer device and the image forming apparatus increases.

When the connecting member 9c for connecting the end cylinders 9a and 9b of the transfer drum 9 and the grippers 7 for gripping the leading edge of the transfer material, which are thicker than the dielectric sheet 93, pass the contact portion, the impact by the leading or trailing edges of the connecting member 9c and the grippers is large if the contact pressure is high. Then, the toner image on the transfer material may scatter, the color toner images may deviate. Since the transfer charging member is in the form of an elastic sheet, blade or roller, the response of re-contact to the dielectric sheet 93 immediately after the passage of the trailing end of the connecting member 9c or the gripper 7 or the like. Particularly it is difficult for the charging member to properly contact to the boundary between the trailing edge-of the connecting member 9c or the like and the dielectric sheet 93, the leading edge of the transfer material, and therefore, the leading end portion of the image on the transfer material, involves remarkably low transfer efficiency, with the possible result of local transfer void adjacent the leading edge of the image.

If the transfer charging member is in the form of a conductive brush 21, conductive fine fibers independently in contact with the dielectric sheet 93, unlike the linear contact as in the case of the elastic sheet, blade or roller charging member. Therefore, the state of contact properly follows the change of the contact pressure along the longitudinal direction (along the axis of the transfer drum 9), difference of the surface roughness of the dielectric sheet 93 and the step provided by the connecting portion 9c of the transfer drum 9, and therefore, the contact of the individual fibers to the dielectric sheet 93 can be maintained soft and uniform.

By adjusting the diameter, material and density of the fibers, the uniform and soft contact can be easily accomplished without increasing the contact pressure. Therefore, the transfer charging member is preferably in the form of a brush.

The conductive brush 21 is supplied with a voltage from a bias voltage source 30 during transfer operation, the electric charge is injected to the dielectric sheet 93 placed in the image transfer region, from the conductive brush 21, by which a transfer electric field is produced between the photosensitive drum 3 and itself, and therefore, the toner image is transferred onto the transfer material on the dielectric sheet 93 from the photosensitive drum 3.

As for the material of the dielectric sheet 93, various materials are usable, or a compound sheet is usable. In this embodiment, the use is made with a polyvinylidene fluoride (PVdF) having a thickness of 150 microns. The volume resistivity of the dielectric sheet is preferably $10^{11}$–$10^{15}$ ohm.cm.

Figure 2:
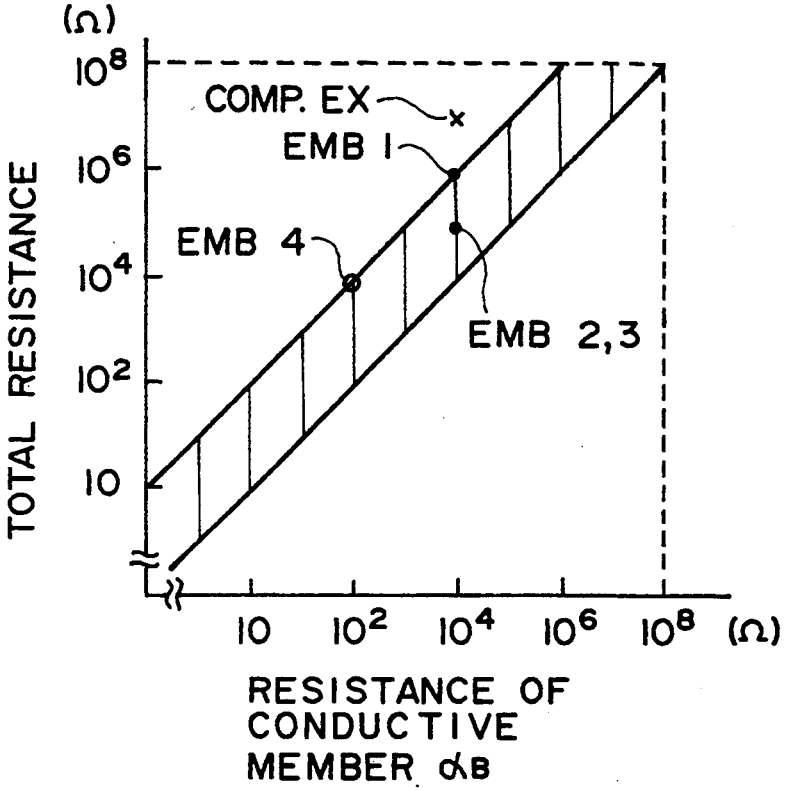
FIG. 2 is a graph showing a preferable range, relative to a resistance $\alpha_B$, of a total resistance $\alpha_T$ which is a sum of a resistance $\alpha_B$ of the conductive brush itself and a contact resistance $\alpha_C$ with the dielectric sheet.

The conductive brush 21 satisfies:

$$(\alpha_B+\alpha_C)/\alpha_B \leqq 100$$

where $\alpha_B$ is a resistance of the brush itself (brush resistance), and $a_C$ is a contact resistance between the brush 21 and the dielectric sheet 93. A sum of the brush resistance $\alpha_B$ and the contact resistance $\alpha_C$ are called total resistance $\alpha_T=\alpha_B+\alpha_C$ (total resistance). FIG. 2 shows a preferable range of $\alpha_T$ $(=\alpha_B+\alpha_C)$ relative to the brush resistance $\alpha_B$.

In this embodiment, the conductive brush 21 is made of fibers of rayon in which carbon is kneaded and mixed, so that the brush resistance $\alpha_B$ of the brush 21 is $10^4$ ohm., total resistance $\alpha_T=\alpha_B+\alpha_C=10^6$ ohm., and a ratio of the total resistance $\alpha_T$ to the brush resistance $\alpha_B$ $(\alpha_T/\alpha_B)=10^2$.

Figure 7:
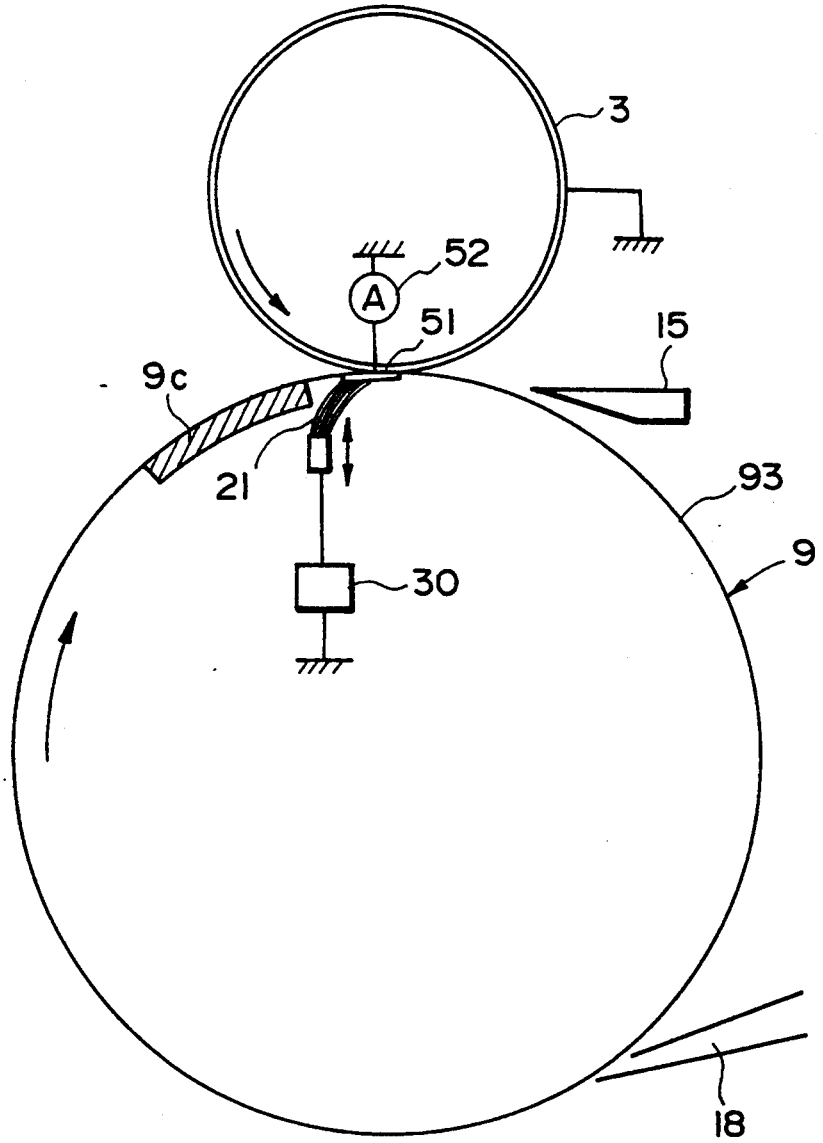
FIG. 7 is a sectional view illustrating measuring method for the total resistance $\alpha_T$ in an image forming apparatus.

The brush resistance $\alpha_B$ is the resistance only of the major part of the brush 21. More particularly, the resistance of only of the brush 21 is measured after the assured electric connection is established between the electrode and the free end of the brush 21 by DOTIGHT (silver paste). The total resistance $\alpha_T$ is a sum of the brush resistance $\alpha_B$ and the contact resistance $\alpha_C$ between the dielectric sheet 93 and the end of the brush 21. More particularly, as shown in FIG. 7, the resistance is measured when the brush 21 is directly contacted to the backside of the dielectric sheet 93 (the state of actual use, pressure is 250 g here). At this time, a non-image forming part of the backside of the dielectric sheet 93 is evaporated with gold to provide an electrode 51. The total resistance $\alpha_T$ is measured by detecting the electric current flowing through the electrode 51 when the brush 21 is supplied with a constant voltage of 100 V by the voltage source 30.

When the diameter of the transfer drum is so small that the non-image portion of the dielectric sheet is not sufficiently large in the direction of the movement of the transfer drum surface, it is preferable that the resistance detecting electrode is on the connecting member of the drum. In such a case, the brush retracts through a distance corresponding the thickness of the connecting member to provide the same state of contact as with the dielectric sheet.

Figure 3:
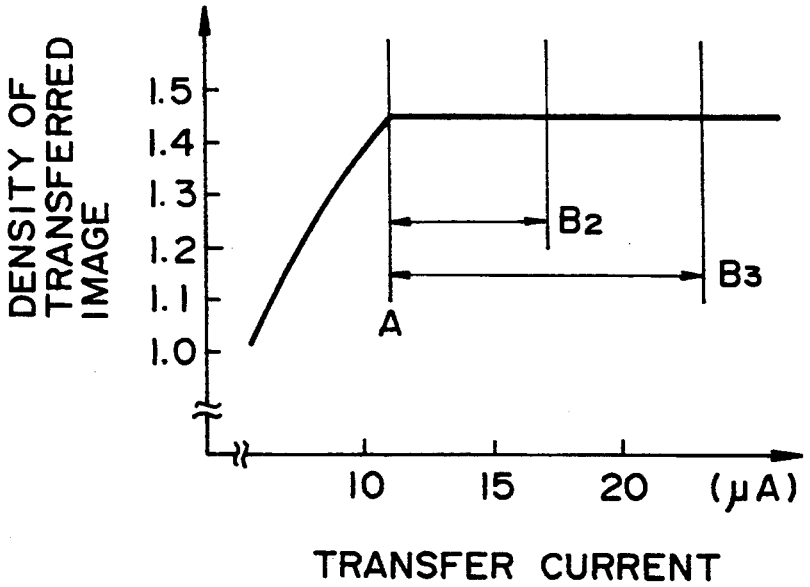
FIG. 3 is a graph of a transfer current under a transfer condition in the image forming apparatus of FIG. 1.

In this embodiment, the use is made with such a brush 21, and the range of the transfer current corresponding to the preferable transfer condition range (transfer latitude) is determined on the basis of the relation between the transfer current and the image density (solid image density) in the low humidity condition (20° C./10%). The results are shown in FIG. 3. The diameter of the fibers of the brush 21 was 20 microns, and the density of the fiber was 8300/inch. The developer used was two component developer having an average particle size of 8 microns (charge amount is 20 μC/g).

As a result, while the transfer current of 11 μA (point A in FIG. 3) is required to provide sufficient image density, abnormal discharge occurs if the current is not less than 16 μA (point $B_2$) with the result of local void of the transfer. Therefore, under these conditions, the transfer current is controlled to be constant within the range between 11–16 μA (between point A–$B_2$ in FIG. 3). By controlling within this current range, good transferred images can be provided without dark and light stripes (transfer void in the pattern of discharge) color non-uniformity stripes (color deviation) toner scattering, leading edge transfer void or the like.

Comparison Example

The use is made with a brush having a brush resistance $\alpha_B=10^3$ ohm, the total resistance $\alpha_T=\alpha_B+\alpha_C=10^7$ ohm ($\alpha_T/\alpha_B=10^4$), and the transfer range was investigated.

As a result, in order to provide the sufficient image density (FIG. 3), 11 μA (point A in the Figure) is required. However, at the point A, the abnormal discharge occurs simultaneously with the transfer operation, and therefore, no good transferred image can be provided under this condition. The used brush 21 had a fiber diameter of 40 microns, a fiber density of 3500/inch.

As will be understood from the foregoing, the preferable range in terms of the total resistance $\alpha_T$ and the contact resistance $\alpha_B$ is as indicated by hatched lines in FIG. 2, that is, $\alpha_T/\alpha_B \leqq 100$. In the case of $\alpha_T=\alpha_B>100$, the abnormal discharge occurs in the transfer charging member with the result of local transfer void.

As described in the foregoing, the brush resistance $\alpha_B$ and the total resistance $\alpha_T$ of the conductive brush 21 are properly selected so as to satisfy $\alpha_T/\alpha_B \leqq 10^2$ by which the wider tolerable range of the transfer condition can be provided under wider ambient condition range. The reason for this is considered as follows.

The ratio of the brush resistance $\alpha_B$ and the total resistance $\alpha_T$ ($\alpha_T/\alpha_B$) represents the state of contact between the end of the brush 21 and the backside of the dielectric sheet 93. With the increase of $\alpha_T/\alpha_B$, the contact state therebetween is worse. When the state of contact becomes worse between the brush 21 and the backside of the dielectric sheet 93, the number or volume of the small gaps between the end of the brush 21 and the sheet 93, increases. When a voltage higher than a predetermined level is applied, the abnormal discharge occurs in the gaps. Therefore, by decreasing $\alpha_T/\alpha_B$, preferably close to 1, the state of contact between the end of the brush 21 and the dielectric sheet 93 is improved, by which the abnormal discharge can be avoided, thus increasing the latitude for the transfer condition.

Embodiment 2

The brush 21 used in the first embodiment is used again in this embodiment. However, the pressure of the brush 21 to the dielectric sheet 93 is increased up to 300 g. By this, the ratio $\alpha_T/\alpha_B=10$. As a result, the latitude of the transfer condition can be expanded. More particularly, the sufficient image density can be provided with the transfer current of 12–23 μA (between points A–$B_3$ in FIG. 3). Thus, the accuracy of the transfer current control can be decreased. This means lowering of the cost for the control system.

Embodiment 3

Figure 4:
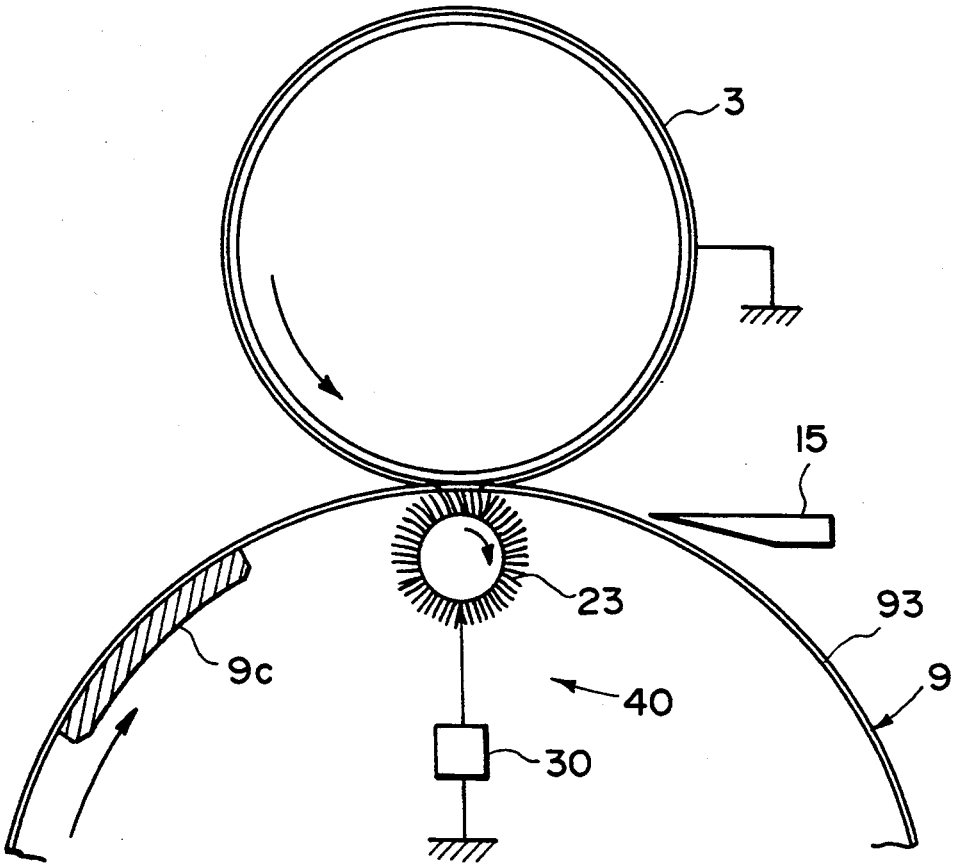
FIG. 4 is a sectional view of an image transfer region in an image forming apparatus according to another embodiment of the present invention.

FIG. 4 is a sectional view of an image transfer region in an image forming apparatus according to a further embodiment. In this embodiment, in place of the conductive brush 21 in the first embodiment (FIG. 1), a electroconductive fur brush roller 23 is used as the transfer charging member. The apparatus of this embodiment is basically the same as the foregoing embodiment in the other respect, and therefore, the detailed description thereof are omitted by assigning the same reference numerals as in FIG. 1 to the elements having the corresponding functions.

In this embodiment, the conductive fur brush roller 23 comprises a metal circular rod having a diameter of 8 mm and conductive fiber cloth bonded thereto by conductive adhesive, the conductive cloth having erected fibers. The fiber length was adjusted to 5 mm, and the roller diameter was 18 mm. The conductive fibers are acrylic fine fibers dyed with copper sulfide for electroconductivity treatment. Similarly to the first embodiment, the fibers may be of stainless steel fibers having a diameter of 8–15 microns, acrylic, nylon, polyester or rayon resin fibers plated with metal, resin material kneaded or mixed with conductive fine particles such as metal particles, carbon fibers provided by carbonating resin fibers or the like for the electroconductivity treatment. The volume resistivity of the conductive fibers is not more than $10^{10}$ ohm.cm, preferably not more than $10^8$ ohm.cm.

The conductive fur brush roller 23 is disposed at a position where the transfer material on the dielectric sheet 93 starts to contact with the photosensitive drum 3 and at the position where the contact ends, or at the positions close thereto. The conductive fur brush roller 23 having elasticity is press-contacted to the dielectric sheet 93. The fur brush roller 23 may be driven by the dielectric sheet 93 at the same peripheral speed thereof, or may be driven by a separate driving means with speed difference.

The present invention is applicable to the case in which the fur brush roller 23 is used, and the use is made with rayon fibers in which carbon is dispersed and which has a fiber resistivity $10^4$ ohm.cm, and a fur brush roller is formed under the conditions of fiber diameter of 20 microns and the fiber density of 8300/inch. The brush resistance $\alpha_B=10^4$ and total resistance $\alpha_T=10^5$ ohm, the ratio $\alpha_T/\alpha_B$ being 10. The wide latitude for the transfer conditions was provided, similarly to the first embodiment.

Embodiment 4

The present invention is applicable to the case of using unwoven conductive cloth as the contact charging member for the electric field forming means. In this embodiment, very fine acrylic resin fibers (fiber diameter of approx. 5 microns) were formed into cloth (unwoven) is dyed for electroconductivity. The volume resistivity thereof was $10^2$ ohm.cm. The electrically conductive unwoven cloth, similarly to the conductive brush of the first embodiment (FIG. 1) and the fur brush roller 23 in the third embodiment (FIG. 4), may be of nylon, polyester, rayon resin materials plated with metal, resin fibers with which conductive fine particles such as carbon or metal powder is kneaded or mixed, very fine carbon fibers produced by carbonizing resin fibers for electroconductivity, if they are formed into unwoven cloth.

In this embodiment, the resistance $\alpha_B$ of the conductive unwoven cloth itself was $10^2$ the total resistance $\alpha_T$ was $10^4$ ohm, and the ratio $\alpha_T/\alpha_B$ was $10^2$ (small circle in FIG. 2). As a result, the wide latitude for the transfer condition could be provided, similarly to the first embodiment.

If the total resistance $\alpha_T$ and the resistance $\alpha_B$ of the transfer charging member satisfy $\alpha_T/\alpha_B \leqq 10$, the transfer latitude is further expanded and therefore, it is preferable.

While the invention has been described with reference to the structures disclosed herein, it is not confined to the details set forth and this application is intended to cover such modifications or changes as may come within the purposes of the improvements or the scope of the following claims.

What is claimed is:

1. An image forming apparatus comprising:

an image bearing member;

toner image forming means for forming a toner image on said image bearing member;

a transfer material carrying member carrying a transfer material;

a transfer charging member for transferring the toner image from said image bearing member onto a transfer material carried on said transfer material carrying member, said transfer charging member being contactable to a backside of the transfer material carrying member not contactable to the transfer material;

wherein $1 \leqq (\alpha_B+\alpha_C)/\alpha_B \leqq 100$ is satisfied where $\alpha_B$ (Ohm) is a resistance of said transfer charging member, and $\alpha_C$ (Ohm) is a constant resistance between a front side of said transfer charging member and the backside of said transfer carrying member.

2. An apparatus according to claim 1, wherein a volume resistivity of the transfer charging member is not more than $10^{10}$ ohm.cm.

3. An apparatus according to claim 2, wherein a volume resistivity of said transfer charging member is not more than $10^8$ ohm.cm.

4. An apparatus according to claim 1, wherein said transfer material carrying member is a dielectric sheet.

5. An apparatus according to claim 1, wherein said toner image forming means forms different color toner images on said image bearing member, and the toner images are sequentially transferred and overlaid on the transfer material carried on said transfer material carrying member.

6. An apparatus according to claim 5, wherein said apparatus is capable of forming a full-color toner image on the transfer material.

7. An apparatus according to claim 1, wherein said transfer material charging member is so disposed that a contact portion with said transfer material carrying member is downstream of a portion where it is supported, with respect to a movement direction of said carrying member.

8. An apparatus according to claim 1, wherein $(\alpha_B+\alpha_C)/\alpha_B \leqq 10$.

9. An apparatus according to any one of claims 1–8, wherein said transfer charging member comprises fibers constituting a brush.

10. An apparatus according to claim 9, further comprising a frame extending substantially perpendicular to a movement direction of the transfer material carrying member and for supporting said transfer material carrying member, and wherein said frame is contactable to said transfer charging member.

* * * * *

UNITED STATES PATENT AND TRADEMARK OFFICE

CERTIFICATE OF CORRECTION

PATENT NO. : 5,410,390

DATED : April 25, 1995

INVENTOR(S) : YASUSHI MIURA, ET AL.

It is certified that error appears in the above-indentified patent and that said Letters Patent is hereby corrected as shown below:

ABSTRACT [57], line 10, "$(\alpha_\beta + \alpha_{c-})$" should read --$(\alpha_\beta + \alpha_c)/\alpha_\beta \leq 100$--; and line 11, "$)\alpha_\beta \leq 100$" should be deleted.

Column 1, line 36, "flow" should read --flows--.

Column 2, line 2, "a" should be deleted;

line 5, "tend" should read --tends--; and line 33, "$\alpha_T$which" should read --$\alpha_T$ which--.

Column 3, line 29, "a" should be deleted.

Column 6, line 42, "of" (second occurrence) should be deleted; and line 64, "corresponding" should read --corresponding to--.

UNITED STATES PATENT AND TRADEMARK OFFICE

CERTIFICATE OF CORRECTION

PATENT NO. : 5,410,390

DATED : April 25, 1995

INVENTOR(S) : YASUSHI MIURA, ET AL.

It is certified that error appears in the above-indentified patent and that said Letters Patent is hereby corrected as shown below:

Column 7,
line 45, "$\alpha_T/\alpha_\beta \leq 10^2$" should read --$\alpha_T/\alpha_\beta \leq 10^2$,--.

Column 8,
line 14, "a" should read --an--; and
line 19, "are" should read --is--.

Column 9,
line 10, "$10^2$" should read --$10^2$,--; and
line 31, "material;" should read --material; and--.

Signed and Sealed this

Twenty-fifth Day of July, 1995

Bruce Lehman

*Attest:*

BRUCE LEHMAN

*Attesting Officer*

*Commissioner of Patents and Trademarks*